United States Patent [19]

Lewis et al.

[11] Patent Number: 4,947,750

[45] Date of Patent: Aug. 14, 1990

[54] PRINTING MEMBER FOR A PRESS WITH DAMPENING

[75] Inventors: Thomas E. Lewis, Hampstead; Bradley W. Davidson, Merrimack; Richard A. Williams, Hampstead, all of N.H.; Michael T. Nowak, Gardner, Mass.; John F. Kline, Hudson, N.H.

[73] Assignee: Presstek, Inc., Hudson, N.H.

[21] Appl. No.: 410,604

[22] Filed: Sep. 21, 1989

Related U.S. Application Data

[62] Division of Ser. No. 234,475, Aug. 19, 1988, Pat. No. 4,911,075.

[51] Int. Cl.[5] ..... B41N 1/08; B41C 1/10

[52] U.S. Cl. ..... 101/459; 101/467

[58] Field of Search ..... 101/458, 459, 467

[56] References Cited

U.S. PATENT DOCUMENTS

| | | | |
|---|---|---|---|
| 4,063,949 | 12/1977 | Uhlig et al. | 101/467 X |
| 4,082,902 | 4/1978 | Suzuki et al. | 346/135.1 X |
| 4,718,340 | 1/1988 | Love, III | 101/128.4 X |

FOREIGN PATENT DOCUMENTS

| | | | |
|---|---|---|---|
| 0062051 | 4/1983 | Japan | 101/459 |

*Primary Examiner*—Clifford D. Crowder

*Attorney, Agent, or Firm*—Nutter, McClennen & Fish

[57] ABSTRACT

A printing member for a press with dampening made by forming on a metal body, e.g. of aluminum, an exposed oxidized surface with a grained surface structure which renders that surface hydrophilic and heating the body surface at selected image points thereon without contacting the surface so that there is a transformation of the surface structure which renders it hydrophobic at the image points.

16 Claims, 3 Drawing Sheets

PRINTING MEMBER FOR A PRESS WITH DAMPENING

RELATED APPLICATION

This application is a division of Ser. No. 234,475, filed Aug. 19, 1988, now Pat. No. 4,911,075.

This invention relates to offset lithography. It relates more specifically to improved lithography plates and method and apparatus for imaging these plates.

BACKGROUND OF THE INVENTION

There are a variety of known ways to print hard copy in black and white and in color. The traditional techniques include letterpress printing, rotogravure printing and offset printing. These conventional printing processes produce high quality copies. However, when only a limited number of copies are required, the copies are relatively expensive. In the case of letterpress and gravure printing, the major expense results from the fact that the image has to be cut or etched into the plate using expensive photographic masking and chemical etching techniques. Plates are also required in offset lithography. However, the plates are in the form of mats or films which are relatively inexpensive to make. The image is present on the plate or mate as hydrophilic and hydrophobic (and ink-receptive) surface areas. In wet lithography, water and then ink are applied to the surface of the plate. Water tends to adhere to the hydrophilic or water-receptive areas of the plate creating a thin film of water there which does not accept ink. The ink does adhere to the hydrophobic areas of the plate and those inked areas, usuallY corresponding to the printed areas of the original document, are transferred to a relatively soft blanket cylinder and, from there, to the paper or other recording medium brought into contact with the surface of the blanket cylinder by an impression cylinder.

Most conventional offset plates are also produced photographically. In a typical negative-working, subtractive process, the original document is photographed to produce a photographic negative. The negative is placed on an aluminum plate having a water-receptive oxide surface that is coated with a photopolymer. Upon being exposed to light through the negative, the areas of the coating that received light (corresponding to the dark or printed areas of the original) cure to a durable oleophilics or ink-receptive state. The plate is then subjected to a developing process which removes the noncured areas of the coating that did not receive light (co responding to the light or background areas of the original). The resultant plate now carries positive or direct image of the original document.

If a press is to print in more than one color, a separate printing plate corresponding to each color is required, each of which is usually made photographically as aforesaid. In addition to preparing the appropriate plates for the different colors, the plates must be mounted properly on the print cylinders in the press and the angular positions of the cylinders coordinated so that the color components printed by the different cylinders will be in register on the printed copies.

The development of lasers has simplified the production of lithographic plates to some extent. Instead of applying the original image photographically to the photoresistcoated printing plate as above, an original document or picture is scanned line-by-line by an optical scanner which develops strings of picture signals, one for each color. These signals are then used to control a laser plotter that writes on and thus exposes the photoresist coating on the lithographic plate to cure the coating in those areas which receive light. That plate is then developed in the usual way by removing the unexposed areas of the coating to create a direct image on the plate for that color. Thus, it is still necessary to chemically etch each plate in order to create an image on that plate.

There have been some attempts to use more-powerful lasers to write images on lithographic plates by volatilizing the surface coating so as to avoid the need for subsequent developing. However, the use of such lasers for this purpose has not been entirely satisfactory because the coating on the plate must be compatible with the particular laser which limits the choice of coating materials. Also, the pulsing frequencies of some lasers used for this purpose are so low that the time required to produce a halftone image on the plate is unacceptably long.

There have also been some attempts to use scanning E-beam apparatus to etch away the surface coatings on plates used for printing. However, such machines are very expensive. In addition, they require the workpiece, i.e. the plate, be maintained in a complete vacuum, making such apparatus impractical for day-to-day use in a printing facility.

An image has also been applied to a lithographic plate by electro-erosion. The type of plate suitable for imaging in this fashion and disclosed in U.S. Pat. No. 4,596,733, has an oleophilic plastic substrate, e.g. Mylar brand plastic film, having a thin coating of aluminum metal with an overcoating containing conductive graphite which acts as a lubricant and protects the aluminum coating against scratching. A stylus electrode in contact with the graphite containing surface coating is caused to move across the surface of the plate and is pulsed in accordance with incoming picture signals. The resultant current flow between the electrode and the thin metal coating is by design large enough to erode away the thin metal coating and the overlying conductive graphite containing surface coating thereby exposing the underlying ink receptive plastic substrate on the areas of the plate corresponding to the printed portions of the original document. This method of making lithographic plates is disadvantaged in that the described electro-erosion process only works on plates whose conductive surface coatings are very thin and the stylus electrode which contacts the surface of the plate sometimes scratches the plate. This degrades the image being written onto the plate because the scratches constitute inadvertent or unwanted image areas on the plate which print unwanted marks on the copies.

Finally, we are aware of a press system, only recently developed, which images a lithographic plate while the plate is actually mounted on the print cylinder in the press. The cylindrical surface of the plate, treated to render it either oleophilic or hydrophylici, is written on by an ink jetter arranged to scan over the surface of the plate. The ink jetter is controlled so as to deposit on the plate surface a thermoplastic image-forming resin or material which has a desired affinity for the printing ink being used to print the copies. For example, the image-forming material may be attractive to the printing ink so that the ink adheres to the plate in the areas thereof where the image-forming material is present and phobic to the "wash" used in the press to prevent inking of the background areas of the image on the plate.

While that prior system may be satisfactory for some applications, it is not always possible to provide thermoplastic image-forming material that is suitable for jetting and also has the desired affinity (philic or phobic) for all of the inks commonly used for making lithographic copies. Also, ink jet printers are generally unable to produce small enough ink dots to allow the production of smooth continuous tones on the printed copies, i.e. the resolution is not high enough.

Thus, although there have been all the aforesaid efforts to improve different aspects of lithographic plate production and offset printing, these efforts have not reached full-fruition primarily because of the limited number of different plate constructions available and the limited number of different techniques for practically and economically imaging those known plates. Accordingly, it would be highly desirable if new and different lithographic plates became available which could be imaged by writing apparatus able to respond to incoming digital data so as to apply a positive or negative image directly to the plate in such a way as to avoid the need of subsequent processing of the plate to develop or fix that image.

SUMMARY OF THE INVENTION

Accordingly, the present invention aims to provide various lithographic plate constructions which can be imaged or written on to form a positive or negative image therein.

Another object is to provide such plates which can be used in a wet or dry press with a variety of different printing inks.

Another object is to provide low cost lithographic plates which can be imaged electrically.

A further object is to provide an improved method for imaging lithographic printing plates.

Another object of the invention is to provide a method of imaging lithographic plates which can be practiced while the plate is mounted in a press.

Still another object of the invention is to provide a method for writing both positive and negative or background images on lithographic plates.

Still another object of the invention is to provide such a method which can be used to apply images to a variety of different kinds of lithographic plates.

A further object of the invention is to provide a method of producing on lithographic plates half tone images with variable dot sizes.

A further object of the invention is to provide improved apparatus for imaging lithographic plates.

Another object of the invention is to provide apparatus of this type which applies the images to the plates efficiently and with a minimum consumption of power.

Still another object of the invention is to provide such apparatus which lends itself to control by incoming digital data representing an original document or picture.

Other objects will, in part, be obvious and will, in part, appear hereinafter. The invention accordingly comprises an article of manufacture possessing the features and properties exemplified in the constructions described herein and the several steps and the relation of one or more of such steps with respect to the others and the apparatus embodying the features of construction, combination of elements and the arrangement of parts which are adapted to effect such steps, all as exemplified in the following detailed description, and the scope of the invention will be indicated in the claims.

In accordance with the present invention, images are applied to a lithographic printing plate by altering the plate surface characteristics at selected points or areas of the plate using a non-contacting writing head which scans over the surface of the plate and is controlled by incoming picture signals corresponding to the original document or picture being copied. The writing head utilizes a precisely positioned high voltage spark discharge electrode to create on the surface of the plate an intense-heat spark zone as well as a corona zone in a circular region surrounding the spark zone. In response to the incoming picture signals and ancillary data keyed in by the operator such as dot size, screen angle, screen mesh, etc. and merged with the picture signals, high voltage pulses having precisely controlled voltage and current profiles are applied to the electrode to produce precisely positioned and defined spark/corona discharges to the plate which etch, erode or otherwise transform selected points or areas of the plate surface to render them either receptive or non-receptive to the printing ink that will be applied to the plate to make the printed copies.

Lithographic plates are made ink receptive or oleophilic initially by providing them with surface areas consisting of unoxidized metals or plastic materials to which oil and rubber based inks adhere readily. On the other hand, plates are made water receptive or hydrophilici initially in one of three ways. One plate embodiment is provided with a plated metal surface, e.g. of chrome, whose topography or character is such that it is wetted by surface tension. A second plate has a surface consisting of a metal oxide, e.g. aluminum oxide, which hydrates with water. The third plate construction is provided with a polar plastic surface which is also roughened to render it hydrophilici. As will be seen later, certain ones of these plate embodiments are suitable for wet printing, others are better suited for dry printing. Also, different ones of these plate constructions ar preferred for direct writing; others are preferred for indirect or background writing.

The present apparatus can write images on all of these different lithographic plates having either ink receptive or water receptive surfaces. In other words, if the plate surface is hydrophilic initially, our apparatus will write a positive or direct image on the plate by rendering oleophilici the points or areas of the plate surface corresponding to the printed portion of the original document. On the other hand, if the plate surface is oleophilic initially, the apparatus will apply a background or negative image to the plate surface by rendering hydrophilici or oleophobic the points or areas of that surface corresponding to the background or non-printed portion of the original document. Direct or positive writing is usually preferred since the amount of plate surface area that has to be written on or converted is less because most documents have less printed areas than non-printed areas.

The plate imaging apparatus incorporating our invention is preferably implemented as a scanner or plotter whose writing head consists of one or more spark discharge electrodes. The electrode (or electrodes) is positioned over the working surface of the lithographic plate and moved relative to the plate so as to collectively scan the plate surface. Each electrode is controlled by an incoming stream of picture signals which is an electronic representation of an original document or picture. The signals can originate from any suitable source such as an optical scanner, a disk or tape reader, a computer, etc. These signals are formatted so that the apparatus' spark discharge electrode or electrodes write a positive or negative image onto the surface of the lithographic plate that corresponds to the original document.

If the lithographic plates being imaged by our apparatus are flat, then the spark discharge electrode or electrodes may be incorporated into a flat bed scanner or plotter. Usually, however, such plates are designed to be mounted to a print cylinder. Accordingly, for most applications, the spark discharge writing head is incorporated into a so-called drum scanner or plotter with the lithographic plate being mounted to the cylindrical surface of the drum. Actually, as we shall see, our invention can be practiced on a lithographic plate already mounted in a press to apply an image to that plate in situ. In this application, then, the print cylinder itself constitutes the drum component of the scanner or plotter.

To achieve the requisite relative motion between the spark dIscharge writing head and the cylindrical plate, the plate can be rotated about its axis and the head moved parallel to the rotation axis so that the plate is scanned circumferentially with the image on the plate "growing" in the axial direction. Alternatively, the writing head can move parallel to the drum axis and after each pass of the head, the drum can be incremented angularly so that the image on the plate grows circumferentially. In both cases, after a complete scan by the head, an image corresponding to the original document or picture will have been applied to the surface of the printing plate.

As each electrode traverses the plate, it is supported on a cushion of air so that it is maintained at a very small fixed distance above the plate surface and cannot scratch that surface. In response to the incoming picture signals, which usually represent a half tone or screened image, each electrode is pulsed or not pulsed at selected points in the scan depending upon whether, according to the incoming data, the electrode is to write or not write at these locations. Each time the electrode is pulsed, a high voltage spark discharge occurs between the electrode tip and the particular point on the plate opposite the tip. The heat from that spark discharge and the accompanying corona field surrounding the spark etches or otherwise transforms the surface of the plate in a controllable fashion to produce an image-forming spot or dot on the plate surface which is precisely defined in terms of shape and depth of penetration into the plate.

Preferably the tip of each electrode is pointed to obtain close control over the definition of the spot on the plate that is affected by the spark discharge from that electrode. Indeed, the pulse duration, current or voltage controlling the discharge may be varied to produce a variable sized dot on the plate. Also, the polarity of the voltage applied to the electrode may be made positive or negative depending upon the nature of the plate surface to be affected by the writing, i.e. depending upon whether ions need to be pulled from or repelled to the surface of the plate at each image point in order to transform the surface at that point to distinguish it imagewise from the remainder of the plate surface, e.g. to render it oleophilici in the case of direct writing on a plate whose surface is hydrophilici. In this way, image spots can be written onto the plate surface that have diameters in the order of 0.005 inch all the way down to 0.0001 inch.

After a complete scan of the plate, then, the apparatus will have applied a complete screened image to the plate in the form of a multiplicity of surface spots or dots which are different in their affinity for ink from the portions of the plate surface not exposed to the spark discharges from the scanning electrode.

Thus, using our method and apparatus, high quality images can be applied to our special lithographic plates which have a variety of different plate surfaces suitable for either dry or wet offset printing. In all cases, the image is applied to the plate relatively quickly and efficiently and in a precisely controlled manner so that the image on the plate is an accurate representation of the printing on the original document. Actually using our technique, a lithographic plate can be imaged while it is mounted in its press thereby reducing set up time considerably. An even greater reduction in set up time results if the invention is practiced on plates mounted in a multi-color press because correct color registration between the plates on the various print cylinders can be accomplished electronically rather than manually by controlling the timings of the input data applied to the electrodes that control the writing of the images on the corresponding plates. As a consequence of the forgoing combination of features, our method and apparatus for applying images to lithographic plates and the plates themselves should receive wide acceptance in the printing industry.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENTS

Figure 1:
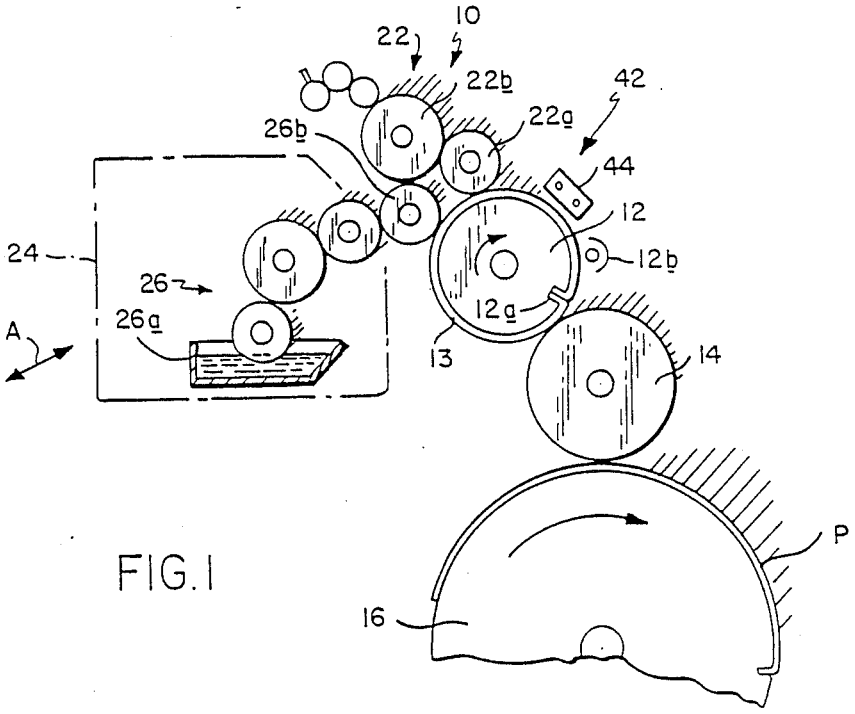
FIG. 1 is a diagrammatic view of an offset press incorporating a lithographic printing plate made in accordance with this invention.

Refer first to FIG. 1 of the drawings which shows a more or less conventional offset press shown generally at 10 which can print copies using lithographic plates made in accordance with this invention.

Press 10 includes a print cylinder or drum 12 around which is wrapped a lithographic plate 13 whose opposite edge margins are secured to the plate by a conventional clamping mechanism **12*a* incorporated into cylinder 12. Cylinder 12, or more precisely the plate 13 thereon, contacts the surface of a blanket cylinder 14 which, in turn, rotates in contact with a large diameter impression cylinder 16. The paper sheet P to be printed on is mounted to the surface of cylinder 16 so that it passes through the nip between cylinders 14 and 16 before being discharged to the exit end of the press 10. Ink for inking plate 13 is delivered by an ink train 22**, the lowermost roll 22a of which is in rolling engagement with plate 13 when press 10 is printing. As is customary in presses of this type, the various cylinders are all geared together so that they are driven in unison by a single drive motor.

The illustrated press 10 is capable of wet as well as dry printing. Accordingly, it includes a conventional dampening or water fountain assembly 24 which is movable toward and away from drum 12 in the directions indicated by arrow A in FIG. 1 between active and inactive positions. Assembly 24 includes a conventional water train shown generally at 26 which conveys water from a tray 26a to a roller 26b which, when the dampening assembly is active, is in rolling engagement with plate 13 and the intermediate roller 22b of ink train 22 as shown in phantom in FIG. 1.

When press 10 is operating in its dry printing mode, the dampening assembly 24 is inactive so that roller 26b is retracted from roller 22b and the plate as shown in solid lines in FIG. 1 and no water is applied to the plate. The lithographic plate on cylinder 12 in this case is designed for such dry printing. See for example plate 138 in FIG. 4D. It has a surface which is oleophobic or non-receptive to ink except in those areas that have been written on or imaged to make them oleophilici or receptive to ink. As the cylinder 12 rotates, the plate is contacted by the ink-coated roller 22a of ink train 22. The areas of the plate surface that have been written on and thus made oleophilici pick up ink from roller 22a. Those areas of the plate surface not written on receive no ink. Thus, after one revolution of cylinder 12, the image written on the plate will have been inked or developed. That image is then transferred to the blanket cylinder 14 and finally, to the paper sheet P which is pressed into contact with the blanket cylinder.

Figure 4A:
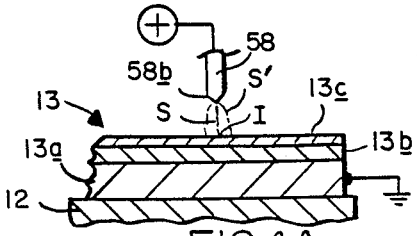
FIGS. 4A to 4F are enlarged sectional views showing imaged lithographic plates incorporating our invention.

When press 10 is operating in its wet printing mode, the dampening assembly 24 is active so that the water roller 26b contacts ink roller 22b and the surface of the plate 13 as shown in phantom in FIG. 1. Plate 13, which is described in more detail in connection with FIG. 4A, is intended for wet printing. It has a surface which is hydrophilici except in the areas thereof which have been written on to make them oleophyllic. Those areas, which correspond to the printed areas of the original document, shun water. In this mode of operation, as the cylinder 12 rotates (clockwise in FIG. 1), water and ink are presented to the surface of plate 13 by the rolls 26b and 22a, respectively. The water adheres to the hydrophilici areas of that surface corresponding to the background of the original document and those areas, being coated with water, do not pick up ink from roller 22a. On the other hand, the oleophylici areas of the plate surface which have not been wetted by roller 26, pick up ink from roller 22a, again forming an inked image on the surface of the plate. As before, that image is transferred via blanket roller 14 to the paper sheet P on cylinder 16.

Figure 2:
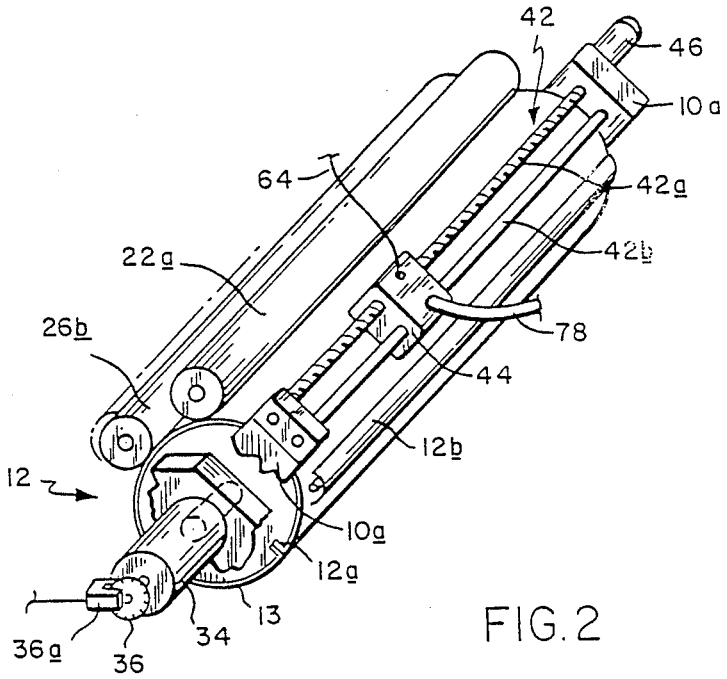
FIG. 2 is an isometric view on a larger scale showing in greater detail the print cylinder portion of the FIG. 1 press.

While the image to be applied to the lithographic plate 13 can be written onto the plate while the plate is "off press", our invention lends itself to imaging the plate when the plate is mounted on the print cylinder 12 and the apparatus for accomplishing this will now be described with reference to FIG. 2. As shown in FIG. 2, the print cylinder 12 is rotatively supported by the press frame 10a and rotated by a standard electric motor 34 or other conventional means. The angular position of cylinder 12 is monitored by conventional means such as a shaft encoder 36 that rotates with the motor armature and associated detector 36a. If higher resolution is needed, the angular position of the large diameter impression cylinder 16 may be monitored by a suitable magnetic detector that detects the teeth of the circumferential drive gear on that cylinder which gear meshes with a similar gear on the print cylinder to rotate that cylinder.

Also supported on frame 10a adjacent to cylinder 12 is a writing head assembly shown generally at 42. This assembly comprises a lead screw 42a whose opposite ends are rotatively supported in the press frame 10a, which frame also supports the opposite ends of a guide bar 42b spaced parallel to lead screw 42a. Mounted for movement along the lead screw and guide bar is a carriage 44. When the lead screw is rotated by a step motor 46, carriage 44 is moved axially with respect to print cylinder 12.

The cylinder drive motor 34 and step motor 46 are operated in synchronism by a controller 50 (FIG. 3), which also receives signals from detector 36a, so that as the drum rotates, the carriage 44 moves axially along the drum with the controller "knowing" the instantaneous relative position of the carriage and cylinder at any given moment. The control circuitry required to accomplish this is already very well known in the scanner and plotter art.

Figure 3:
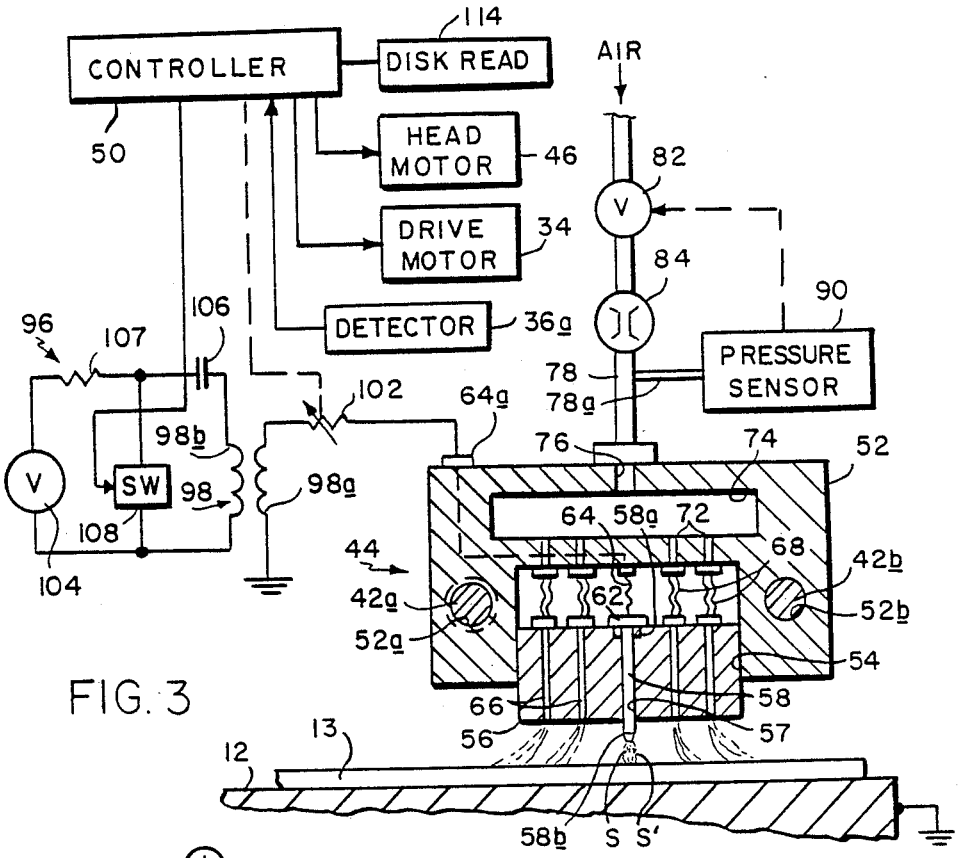
FIG. 3 is a sectional view taken along line 3—3 of FIG. 2 on a larger scale showing the writing head that applies an image to the surface of the FIG. 2 print cylinder, with the associated electrical components being represented in a block diagram.

Refer now to FIG. 3 which depicts an illustrative embodiment of carriage 44. It includes a block 52 having a threaded opening 52a for threadedly receiving the lead screw 42a and a second parallel opening 52b for slidably receiving the guide rod 42b. A bore or recess 54 extends in from the underside of block 52 for slidably receiving a discoid writing head 56 made of a suitable rigid electrical insulating material. An axial passage 57 extends through head 56 for sunugly receiving a wire electrode 58 whose diameter has been exaggerated for clarity. The upper end 58a of the wire electrode is received and anchored in a socket 62 mounted to the to of head 56 and the lower end 58b of the electrode 58 is preferably pointed as shown in FIG. 3. Electrode 58 is made of an electrically conductive metal, such as thoriated tungsten, capable of withstanding very high temperatures. An insulated conductor 64 connects socket 62 to a terminal 64a at the top of block 52. If the carriage 44 has more than one electrode 58, similar connections are made to those electrodes so that a plurality of points on the plate 13 can be imaged simultaneously by assembly 42.

Also formed in head 56 are a plurality of small air passages 66. These passages are distributed around electrode 58 and the upper ends of the passages are connected by way of flexible tubes or hoses 68 to a corresponding plurality of vertical passages 72. These passages extend from the inner wall of block bore 54 to an air manifold 74 inside the block which has an inlet passage 76 extending to the top of the block. Passage 76 is connected by a pipe 78 to a source of pressurized air. In the line from the air source is an adjustable valve 82 and a flow restrictor 84. Also, a branch line 78a leading from pipe 78 downstream from restrictor 84 connects to a pressure sensor 90 which produces an output for controlling the setting of valve 82.

When the carriage 44 is positioned opposite plate 13 as shown in FIG. 3 and air is supplied to its manifold 74, the air issues from the lower ends of passages 66 with sufficient force to support the head above the plate surface. The back pressure in passages 66 and manifold 74 varies directly with the spacing of head 56 from the surface of plate 13 and this back pressure is sensed by pressure sensor 90. The sensor controls valve 82 to adjust the air flow to head 56 so that the tip **58*b* of the needle electrode 58 is maintained at a precisely controlled very small spacing, e.g. 0.0001 inch, above the surface of plate 13 as the carriage 44** scans along the surface of the plate.

Still referring to FIG. 3, the writing head 56, and particularly the pulsing of its electrode 58, is controlled by a pulse circuit 96. One suitable circuit comprises a transformer 98 whose secondary winding **98*a* is connected at one end by way of a variable resistor 102 to terminal 64*a* which, as noted previously, is connected electrically to electrode 58. The opposite end of winding 98*a* is connected to electrical ground. The transformer primary winding 98*b* is connected to a DC voltage source 104 that supplies a voltage in the order of 1000 volts. The transformer primary circuit includes a large capacitor 106 and a resistor 107 in series. The capacitor is maintained at full voltage by the resistor 107. An electronic switch 108 is connected in shunt with winding 98*b* and the capacitor. This switch is controlled by switching signals received from controller 50**.

It should be understood that circuit 96 specifically illustrated is only one of many known circuits that can be used to provide variable high voltage pulses of short duration to electrode 58. For example, a high voltage switch and a capacitor-regenerating resistor may be used to avoid the need for transformer 98. Also, a bias voltage may be applied to the electrode 58 to provide higher voltage output pulses to the electrode without requiring a high voltage rating on the switch.

When an image is being written on plate 13, the press 10 is operated in a non-print or imaging mode with both the ink and water rollers **22*a* and 26*b* being disengaged from cylinder 12. The imaging of plate 13 in press 10 is controlled by controller 50 which, as noted previously, also controls the rotation of cylinder 12 and the scanning of the plate by carriage assembly 42. The signals for imaging plate 13 are applied to controller 50 by a conventional source of picture signals such as a disk reader 114. The controller 50 synchronizes the image data from disk reader 114 with the control signals that control rotation of cylinder 12 and movement of carriage 44 so that when the electrode 58 is positioned over uniformly spaced image points on the plate 13, switch 108** is either closed or not closed depending upon whether that particular point is to be written on or not written on.

If that point is not to be written on, i.e. it corresponds to a location in the background of the original document, the electrode is not pulsed and proceeds to the next image point. On the other hand, if that point in the plate does correspond to a location in the printed area of the original document, switch 108 is closed. The closing of that switch discharges capacitor 106 so that a precisely shaped, i.e. squarewave, high voltage pulse, i.e. 1000 volts, of only about one microsecond duration is applied to transformer 98. The transformer applies a stepped up pulse of about 3000 volts to electrode 58 causing a spark discharge S between the electrode tip **58*b* and plate 13. That sparks and the accompanying corona field S′ surrounding the spark zone etches or transforms the surface of the plate at the point thereon directly opposite the electrode tip 58*b*** to render that point either receptive or non-receptive to ink, depending upon the type of surface on the plate.

The transformations that do occur with our different lithographic plate constructions will be described in more detail later. Suffice it to say at this point, that resistor 102 is adjusted for the different plate embodiments to produce a spark discharge that writes a clearly defined image spot on the plate surface which is in the order of 0.005 to 0.0001 inch in diameter. That resistor 102 may be varied manually or automatically via controller 50 to produce dots of variable size. Dot size may also be varied by varying the voltage and/or duration of the pulses that produce the spark discharges. Means for doing this are quite well known in the art. Likewise, dot size may be varied by repeated pulsing of the electrode at each image point, the number of pulses determining the dot size (pulse count modulation). If the electrode has a pointed end **58*b* as shown and the gap between tip 58*b*** and the plate is made very small, i.e. *0.001* inch, the spark discharge is focused so that image spots as small as 0.0001 inch or even less can be formed while keeping voltage requirements to a minimum. The polarity of the voltage applied to the electrode may be positive or negative although preferably, the polarity is selected according to whether ions need to be pulled from or repelled to the plate surface to effect the desired surface transformations on the various plates to be described.

As the electrode 58 is scanned across the plate surface, it can be pulsed at a maximum rate of about 500,000 pulses/sec. However, a more typical rate is 25,000 pulses/sec. Thus, a broad range of dot densities can be achieved, e.g. 2,000 dots/inch to 50 dots/inch. The dots can be printed side-by-side or they may be made to overlap so that substantially 100% of the surface area of the plate can be imaged. Thus, in response to the incoming data, an image corresponding to the original document builds up on the plate surface constituted by the points or spots on the plate surface that have been etched or transformed by the spark discharge S, as compared with the areas of the plate surface that have not been so affected by the spark discharge.

In the case of axial scanning, then, after one revolution of print cylinder 12, a complete image will have been applied to plate 13. The press 10 can then be operated in its printing mode by moving the ink roller **22*a* to its inking position shown in solid lines in FIG. 1, and, in the case of wet printing, by also shifting the water fountain roller 26*b* to its dotted line position shown in FIG. 1. As the plate rotates, ink will adhere only to the image points written onto the plate that correspond to the printed portion of the original document. That ink image will then be transferred in the usual way via blanket cylinder 14 to the paper sheet P mounted to cylinder 16**.

Forming the image on the plate 13 while the plate is on the cylinder 12 provides a number of advantages, the most important of which is the significant decrease in the preparation and set up time, particularly if the invention is incorporated into a multi-color press. Such a press includes a plurality of sections similar to press 10 described herein, one for each color being printed. Whereas normally the print cylinders in the different press sections after the first are adjusted axially and in phase so that the different color images printed by the lithographic plates in the various press sections will appear in register on the printed copies, it is apparent from the foregoing that, since the images are applied to the plates 13 while they are mounted in the press sections, such print registration can be accomplished electronically in the present case.

More particularly, in a multicolor press, incorporating a plurality of press sections similar to press 10, the controller 50 would adjust the timings of the picture signals controlling the writing of the images at the second and subsequent printing sections to write the image on the lithographic plate 13 in each such station with an axial and/or angular offset that compensates for any misregistration with respect to the image on the first plate 13 in the press. In other words, instead of achieving such registration by repositioning the print cylinders or plates, the registration errors are accounted for when writing the images on the plates. Thus once imaged, the plates will automatically print in perfect register on paper sheet P.

Refer now to FIGS. 4A to 4F which illustrate various lithographic plate embodiments which are capable of being imaged by the apparatus depicted in FIGS. 1 to 3. In FIG. 4A, the plate 13 mounted to the print cylinder 12 comprises a steel base or substrate layer **13*a* having a flash coating 13*b* of copper metal which is, in turn, plated over by a thin layer 13*c* of chrome metal. As described in detail in U.S. Pat. No. 4,596,760, the plating process produces a surface topography or texture which is hydrophylici. Therefore, plate 13** is a preferred one for use in a dampening-type offset press.

During a writing operation on plate 13 as described above, voltage pulses are applied to electrode 58 so that spark discharges S occur between the electrode tip **58*b* and the surface layer 13*c* of plate 13. Each spark discharge, coupled with the accompanying corona field S′ surrounding the spark zone, melts the surface of layer 13*c* at the imaging point I on that surface directly opposite tip 58*b*. Such melting suffices to modify the surface structure or topography at that point on the surface so that water no longer tends to adhere to that surface area. Accordingly, when plate 13** is imaged in this fashion, a multiplicity of non-water-receptive spots or dots I are formed on the otherwise hydrophylici plate surface, which spots or dots represent the printed portion of the original document being copied.

When press 10 is operated in its wet printing mode, i.e. with dampening assembly 24 in its position shown in phantom in FIG. 1, the water from the dampening roll **26*b* adheres only to the surface areas of plate 13 that were not subjected to the spark discharges from electrode 58 during the imaging operation. On the other hand, the ink from the ink roll 22*a* does adhere to those plate surface areas written on, but does not adhere to the surface areas of the plate where the water or wash solution is present. When printing, the ink adhering to the plate, which forms a direct image of the original document, is transferred via the blanket cylinder 14 to the paper sheet P on cylinder 16. While the polarity of the voltage applied to electrode 58 during the imaging process described above can be positive or negative, we have found that for imaging a plate with a chrome surface such as the one in FIG. 4A**, a positive polarity is preferred because it enables better control over the formation of the spots or dots on the surface of the plate.

Figure 4B:
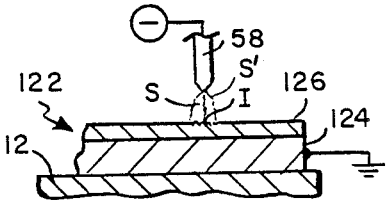

FIG. 4B illustrates another plate embodiment which is written on directly and used in a dampening-type press. This plate, shown generally at 122 in FIG. 4B, has a substrate 124 made of a metal such as aluminum which has a structured oxide surface layer 126. This surface layer may be produced by any one of a number of known chemical treatments, in some cases assisted by the use of fine abrasives to roughen the plate surface. The controlled oxidation of the plate surface is commonly called anodizing while the surface structure of the plate is referred to as grain or graining. As part of the chemical treatment modifiers such as silicates, phosphates, etc. are used to stabilize the hydrophilici character of the plate surface and to promote both adhesion and the stability of the photosensitive layer(s) that are coated on the plates.

The aluminum oxide on the surface of the plate is not the crystalline structure associated with corundum or a laser ruby (both are aluminum oxide crystals), and shows considerable interaction with water to form hydrates of the form $Al_2O_3.H_2O$. This interaction with contributions from silicate, phosphate, etc. modifiers is the source of the hydrophylici nature of the plate surface. Formation of hydrates is also a problem when the process proceeds unchecked. Eventually a solid hydrate mass forms that effectively plugs and eliminates the structure of the plate surface. Ability to effectively hold a thin film of water required to produce nonimage areas is thus lost which renders the plate useless. Most plates are supplied with photosensitive layers in place that protect the plate surfaces until the time the plates are exposed and developed. At this point, the plates are either immediately used or stored for use at a later time. If the plates are stored, they are coated with a water soluble polymer to protect hydrophylici surfaces. This is the process usually referred to as gumming in the trade. Plates that are supplied without photosensitive layers are usually treated in a similar manner.

The of hydrophylici character during storage or extended interruptions while the plate is being used is generally referred to as oxidation in the trade. Depending on the amount of structuring and chemical modifiers used, there is a considerable variation in plate sensitivity to excessive hydration.

When the plate 122 is subjected to the spark discharge from electrode 58, the heat from the spark S and associated corona S′ around the spark zone renders oleophylici or ink receptive a precisely defined image point I opposite the electrode tip **58*b***.

The behavior of the imaged aluminum plate suggests that the image points I are the result of combined partial processes. It is believed that dehydration, some formation of fused aluminum oxide, and the melting and transport to the surface of aluminum metal occur. The combined effects of the three processes, we suppose, reduce the hydrophylici character of the plate surface at the image point. Aluminum is chemically reactive with the result that the metal is always found with a thin oxide coating regardless of how smooth or bright the metal appears. This oxide coating does not exhibit a hydrophylici character, which agrees with our observation that an imaged aluminum-based plate can be stored in air more than 24 hours without the loss of an image. In water, aluminum can react rapidly under both basic and acidic conditions including several electrochemical reactions. The mildly acidic fountain solutions used in presses are believed to have this effect on the thin films of aluminum exposed during imaging resulting in their removal.

Because of the above-mentioned ability of the imaged surface areas of the plate to react with water, protection of the just-imaged plate 122 requires that the plate surface be shielded from contact with water or water-based materials. This may be done by applying ink to the plate without the use of a dampening or fountain solution, i.e. with water roll **26*b* disengaged in FIG. 1**.

This results in the entire plate surface being coated with a layer of ink. Dampening water is then applied (i.e. the water roll 26b is engaged) to the plate. Those areas of the plate that were not imaged acquire a thin film of water that dislodges the overlying ink allowing its removal from the plate. The plate areas that were imaged do not acquire a thin film of water with the result that the ink remains in place.

The images generated on a chrome plate show a similar sensitivity to water contact preceding ink contact. However, after the ink application step, the images on a chrome plate are more stable and the plate can be run without additional steps to preserve the image.

The ink remaining on the image points I is quite fragile and must be left to dry or set so that the ink becomes more durable. Alternatively, a standard ink which cures or sets in response to ultraviolet light or heat may be used with plate 122. In this event, a standard ultraviolet lamp 126 may be mounted adjacent to print cylinder 12 as depicted in FIGS. 1 and 2 to cure the particular ink. The lamp 126 should extend the full length of cylinder 12 and be supported by frame members 10a close to the surface of cylinder 12 or, more particularly, the lithographic plate thereon.

We have found that imaging a plate such as plate 122 based on aluminum is optimized if a negative voltage is applied to the imaging electrode 58. This is because positive aluminum ions produced at each image point migrate well in the high intensity current flow of the spark discharge and will move toward the negative electrode.

Figure 4C:
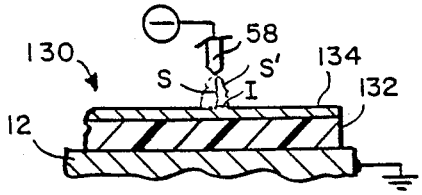

FIG. 4C shows a plate embodiment 130 suitable for direct imaging in a press without dampening. Plate 130 comprises a substrate 132 made of a conductive metal such as aluminum or steel. The substrate carries a thin coating 134 of a highly oleophobic material such as a fluoropolymer or silicone. One suitable coating material is an addition-cured release coating marketed by Dow Corning under its designation SYL-OFF 7044. Plate 130 is written on or imaged by decomposing the surface of coating 134 using spark discharges from electrode 58. The heat from the spark and associated corona decompose the silicone coating into silicon dioxide, carbon dioxide, and water. Hydrocarbon fragments in trace amounts are also possible depending on the chemistry of the silicone polymers used. Silicone resins do not have carbon in their backbones which means various polar structures such as C—OH are not formed. Silanols, which are Si—OH structures are possible structures, but these are reactive which means they react to form other, stable structures.

Such decomposition coupled with surface roughening of coating 134 due to the spark discharge renders that surface oleophilici at each image point I directly opposite the tip of electrode 58. Preferably that coating is made quite thin, e.g. 0.0003 inch to minimize the voltage required to break down the material to render it ink receptive. Resultantly, when plate 130 is inked by roller 22a in press 10, ink adheres only to those transformed image points I on the plate surface. Areas of the plate not so imaged, corresponding to the background area of the original document to be printed, do not pick up ink from roll 22a. The inked image on the plate is then transferred by blanket cylinder 14 to the paper sheet P as in any conventional offset press.

Figure 4D:
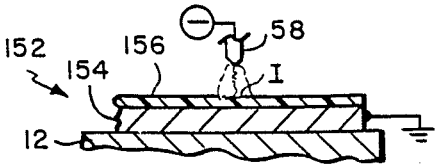

FIG. 4D illustrates a lithographic plate 152 suitable for indirect imaging and for wet printing. The plate 152 comprises a substrate 154 made of a suitable conductive metal such as aluminum or copper. Applied to the surface of substrate 154 is a layer 156 of phenolic resin, parylene, diazo-resin or other such material to which oil and rubber-based inks adhere readily. Suitable positive working, subtractive plates of this type are available from the Enco Division of American Hoechst Co. under that company's designation P-800.

When the coating 156 is subjected to a spark discharge from electrode 58, the image point I on the surface of layer 156 opposite the electrode tip 58b decomposes under the heat and becomes etched so that it readily accepts water. Actually, if layer 156 is thick enough, substrate 154 may simply be a separate flat electrode member disposed opposite the electrode 58. Accordingly, when the plate 152 is coated with water and ink by the rolls 26b and 22a , respectively, of press 10, water adheres to the image points I on plate 152 formed by the spark discharges from electrode 58. Ink, on the other hand, shuns those water-coated surface points on the plate corresponding to the background or non-printed areas of the original document and adheres only to the non-imaged areas of plate 152.

Figure 4E:
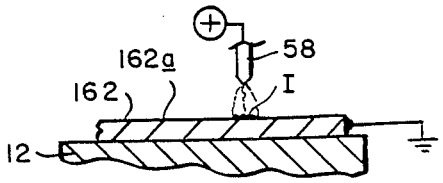

Another offset plate suitable for indirect writing and for use in a wet press is depicted in FIG. 4E. This plate, indicated at 162 in that figure, consists simply of a metal plate, for example, copper, zinc or stainless steel, having a clean and polished surface 162a. Metal surfaces such as this are normally oleophylici or ink-receptive due to surface tension. When the surface 162a is subjected to a spark discharge from electrode 58, the spark and ancillary corona field etch that surface creating small capillaries or fissures in the surface at the image point I opposite the electrode tip 58b which tend to be receptive to or wick up water. Therefore, during printing the image points I on plate 162, corresponding to the background or non-printed areas of the original document, receive water from roll 26b of press 10 and shun ink from the ink roll 22a. Thus ink adheres only to the areas of plate 162 that were not subjected to spark discharges from electrode 58 as described above and which correspond to the printed portions of the original document.

Figure 4F:
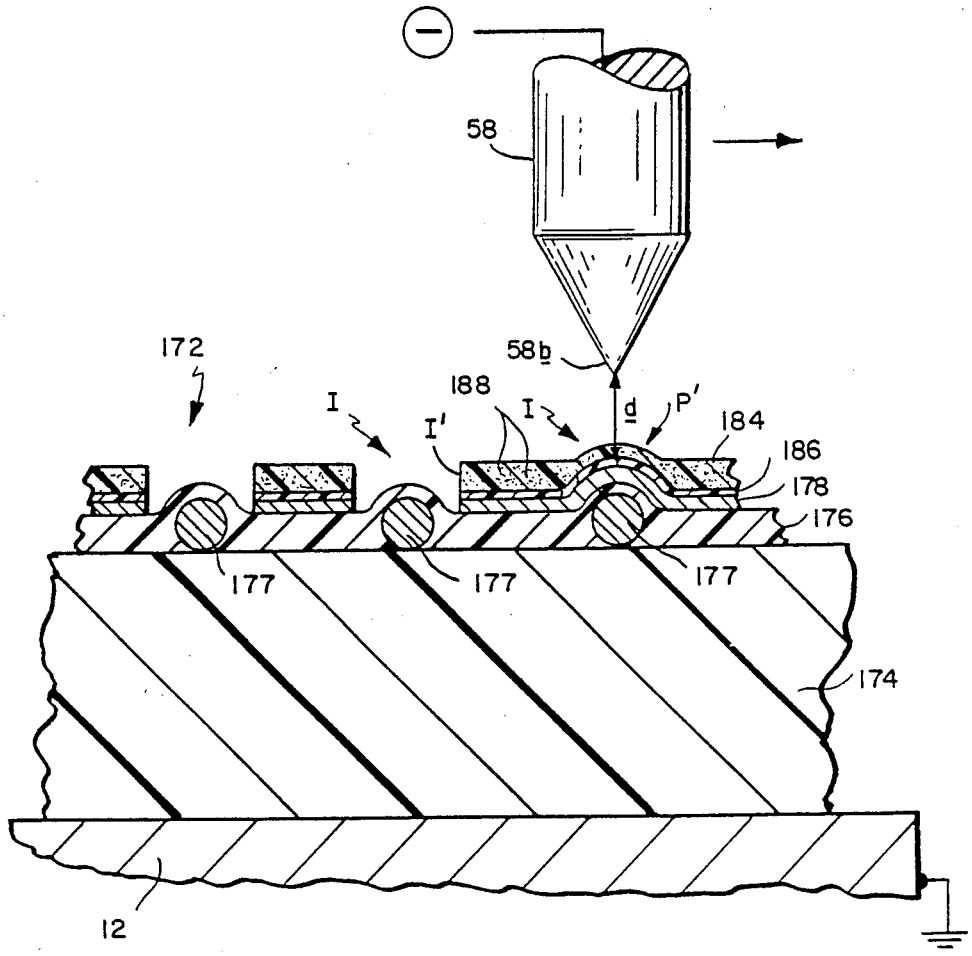

Refer now to FIG. 4F which illustrates still another plate embodiment 172 suitable for direct imaging and for use in an offset press without dampening. We have found that this novel plate 172 actually produces the best results of all of the plates described herein in terms of the quality and useful life of the image impressed on the plate.

Plate 172 comprises a base or substrate 174, a base coat or layer 176 containing pigment or particles 177, a thin conductive metal layer 178, an ink repellent silicone top or surface layer 184, and, if necessary, a primer layer 186 between layers 178 and 184.

1. Substrate 174

The material of substrate 174 should have mechanical strength, lack of extension (stretch) and heat resistance. Polyester film meets all these requirements well and is readily available. Dupont's Mylar and ICI's Melinex are two commercially available films. Other films that can be used for substrate 174 are those based on polyimides (Dupont's Kapton) and polycarbonates (GE's Lexan). A preferred thickness is 0.005 inch, but thinner and thicker versions can be used effectively.

There is no requirement for an optically clear film o a smooth film surface (within reason). The use of pigmented films including films pigmented to the point of opacity are feasible for the substrate, providing mechanical properties are not lost.

2. Base Coat 176

An important feature of this layer is that it is strongly textured. In this case, "textured" means that the surface topology has numerous peaks and valleys. When this surface is coated with the thin metal layer 178, the projecting peaks create a surface that can be described as containing numerous tiny electrode tips (point source electrodes) to which the spark from the imaging electrode 58 can jump. This texture is conveniently created by the filler particles 177 included in the base coat, as will be described in detail hereinafter under the section entitled Filler Particles 177. Other requirements of base coat 176 include:

(a) adhesion to the substrate 174;

(b) metallizable using typical processes such as vapor deposition or sputtering and providing a surface to which the metal(s) will adhere strongly;

(c) resistance to the components of offset printing inks and to the cleaning materials used with these inks;

(d) heat resistance; and (e) flexibility equivalent to the substrate.

The chemistry of the base coat that can be used is wide ranging. Application can be from solvents or from water. Alternatively, 100% solids coatings such as characterize conventional UV and EB curable coating can be used. A number of curing methods (chemical reactions that create crosslinking of coating components) can be used to establish the performance properties desired of the coatings. Some of these are:

(a) Thermoset: Typical thermoset reactions are those as an aminoplast resin with hydroxyl sites of the primary coating resin. These reactions are greatly accelerated by creation of an acid environment and the use of heat.

b) Isocyanate-Based: One typical approach are two part urethanes in which an isocynate component reacts with hydroxyl sites on one or more "backbone" resins often referred to as the "polyol" component. Typical polyols include polyethers, polyesters, an acrylics having two or more hydroxyl functional sites. Important modifying resins include hydroxyl functional vinyl resins and cellulose ester resins. The isocyanate component will have two or more isocyanate groups and is either monomeric or oligomeric. The reactions will proceed at ambient temperatures, but can be accelerated using heat and selected catalysts which include tin compounds and tertiary amines. The normal technique is to mix the isocynate functional component(s) with the polyol component(s) just prior to use. The reactions begin, but are slow enough at ambient temperatures to allow a "potlife" during which the coating can be applied.

In another approach, the isocyanate is used in a "blocked" form in which the isocyanate component has been reacted with another component such as a phenol or a ketoxime to produce an inactive, metastable compound This compound is designed for decomposition at elevated temperatures to liberate the active isocyanate component which then reacts to cure the coating, the reaction being accelerated by incorporation of appropriate catalysts in the coating formulation.

(c) Aziridines: The typical use is the crosslinking of waterborne coatings based on carboxyl functional resins. The carboxyl groups are incorporated into the resins to provide sites that form salts with water soluble amines, a reaction integral to the solubilizing or dispersing of the resin in water. The reaction proceeds at ambient temperatures after the water and solubilizing amine(s) have been evaporated upon deposition of the coating. The aziridines are added to the coating at the time of use and have a potlife governed by their rate of hydrolysis in water to produce inert by-products.

(d) Epoxy Reactions: The elevated temperatures cure of boron trifluoride complex catalyzed resins can be used, particularly for resins based on cycloaliphatic epoxy functional groups. Another reaction is based on UV exposure generated cationic catalysts for the reaction. Union Carbide's Cyracure brand system is a commercially available version.

(e) Radiation Cures: These are usually free radical polymerizations of mixtures of monomeric and oligomeric acrylates and methacrylates. Free radicals to initiate the reaction are created by exposure of the coating to an electron beam or by a photoinitiation system incorporated into a coating to be cured by UV exposure. The choice of chemistry to be used will depend on the type of coating equipment to be used and environmental concerns rather than a limitation by required performance properties. A crosslinking reaction is also not an absolute requirement For example, there are resins soluble in a limited range of solvents not including those typical of offset inks and their cleaners that can be used.

3. Filler Particles 177

The filler particles 177 used to create the important surface structure are chosen based on the following considerations:

(a) the ability of a particle 177 of a given size to contribute to the surface structure of the base coat 176. This is dependent on the thickness of the coating to be deposited. This is illustrated for a 5 micron thick (0.0002 inch) coat 176 pigmented with particles 177 of spherical geometry that remain well dispersed throughout deposition and curing of the coat. Particles with diameters of 5 microns and less would not be expected to contribute greatly to the surface structure because they could be contained within the thickness of the coating. Larger particles, e.g. 10 microns in diameter, would make significant contributions because they could project 5 microns above the base coat 176 surface, creating high points that are twice the average thickness of that coat;

(b) the geometry of the particles 177 is important. Equidimensional particles such as the spherical particles described above and depicted in FIG. 4F will contribute the same degree regardless of particle orientation within the base coat and are therefore preferred. Particles with one dimension much greater than the others, acicular types being one example, are not usually desirable. These particles will tend to orient themselves with their long dimensions parallel to the surface of the coating, creating low rounded ridges rather than the desirable distinct peaks. Particles that are platelets are also undesirable. These particles tend to orient themselves with their broad dimensions (faces) parallel to the coating surface, thereby creating low, broad, rounded mounds rather than desirable, distinct peaks;

(c) the total particle content or density within the coating is a function of the image density to be encountered. For example, if the plate is to be imaged at 400 dots per centimeter or 160,000 dots per square centimeter, it would be desirable to have at least that many peaks (particles) present and positioned so that one occurs at each of the possible positions at which a dot may be created. For a coating 5 microns thick, with peaks produced by individual particles 177, this would correspond to a density of $3.2 \times 10^8$ particles/cubic centimeter (in the dried, cured base coat 176).

Particle sizes, geometries, and densities are readily available data for most filler particle candidates, but there are two important complications. Particle sizes are averages or mean valves that describe the distribution of sizes that are characteristic of a given powder or pigment as supplied. This means that both larger and smaller sizes than the average or mean are present and are significant contributors to particle size considerations. Also, there is always some degree of particle association present when particles are dispersed into a fluid medium, which usually increases during the application and curing of a coating. Resultantly, peaks are produced by groups of particles, as well as by individual particles.

Preferred filler particles 177 include the following:

(a) amorphous silicas (via various commercial processes);

(b) microcrystalline silicas;

(c) synthetic metal oxides (single and in multi-component mixtures);

(d) metal powders (single metals, mixtures and alloys);

(e) graphite (synthetic and natural);

(f) carbon black (via various commercial processes).

Preferred particle sizes for the filler particles to be used is highly dependent on the thickness of the layer 176 to be deposited. For a 5 micron thick layer (preferred application), the preferred sizes fall into one of the following two ranges:

(a) 10+/−5 microns for particles 177 that act predominantly as individuals to create surface structure, and (b) 4 +/−2 microns for particles that act as groups (agglomerates) to create surface structure.

For both particle ranges, it should be understood that larger and smaller sizes will be present as part of a size distribution range, i.e. the values given are for the average or mean particle size.

The method of coating base layer 176 with the particles 177 dispersed therein onto the substrate 174 may be by any of the currently available commercial coating processes.

A preferred application of the base coat is as a layer 5 +/−2 microns thick. In practice, it is expected that base coats could range from as little as 2 microns to as much as 10 microns in thickness. Layers thicker than 10 microns are possible, and may be required to produce plates of high durability, but there would be considerable difficulty in texturing these thick coatings via the use of filler pigments.

Also, in some cases, the base coat 176 may not be required if the substrate 174 has the proper, and in a sense equivalent, properties. More particularly, the use for substrate 174 of films with surface textures (structures) created by mechanical means such as embossing rolls or by the use of filler pigments may have an important advantage in some applications provided they meet two conditions:

(a) the films are metalizable with the deposited metal forming layer 178 having adequate adhesion, and (b) their film surface texture produces the important feature of the base coat described in detail above.

4. Thin Metal Layer 178

This layer 178 is important to formation of an image and must be uniformly present if uniform imaging of the plate is to occur. The image carrying (i.e. ink receptive) areas of the plate 172 are created when the spark discharge volatizes a portion of the thin metal layer 178. The size of the feature formed by a spark discharge from electrode tip **58*b*** of a given energy is a function of the amount of metal that is volatized. This is, in turn, a function of the amount of metal present and the energy required to volatize the metal used. An important modifier is the energy available from oxidation of the volatized metal (i.e. that can contribute to the volatizing process), an important partial process present when most metals are vaporized into a routine or ambient atmosphere.

The metal preferred for layer 178 is aluminum, which can be applied by the process of vacuum metallization (most commonly used) or sputtering to create a uniform layer 300 +/−100 Angstroms thick. Other suitable metals include chrome, copper and zinc. In general, any metal or metal mixture, including alloys, that can be deposited on base coat 176 can be made to work, a consideration since the sputtering process can then deposit mixtures, alloys, refractories, etc. Also, the thickness of the deposit is a variable that can be expanded outside the indicated range. That is, it is possible to image a plate through a 1000 Angstrom layer of metal, and to image layers less than 100 Angstroms thick. The use of thicker layers reduces the size of the image formed, which is desirable when resolution is to be improved by using smaller size images, points or dots.

5. Primer 186 (when required)

The primer layer 186 anchors the ink repellent silicone coating 184 to the thin metal layer 178. Effective primers include the following:

(a) silanes (monomers and polymeric forms);

(b) titanates;

(c) polyvinyl alcohols; and (d) polyimides and polyamide-imides.

Silanes and titanates are deposited from dilute solutions, typically 1–3% solids, while polyvinyl alcohols, polyimides, and polyamides-imides are deposited as thin films, typically 3 +/−1 microns. The techniques for the use of these materials is well known in the art.

6. Ink Repellent Silicone Surface Layer 184

As pointed out in the background section of the application, the use of a coating such as this is not a new concept in offset printing plates. However, many of the variations that have been proposed previously involve a photosensitizing mechanism. The two general approaches have been to incorporate the photoresponse into a silicone coating formulation, or to coat silicone over a photosensitive layer. When the latter is done, photoexposure either results in firm anchorage of the silicone coating to the photosensitive layer so that it will remain after the developing process removes the unexposed silicone coating to create image areas (a positive working, subtractive plate) or the exposure destroys anchorage of the silicone coating to the photosensitive layer so that it is removed by "developing" to create image areas leaving the unexposed silicone coating in place (a negative working, subtractive plate). Other approaches to the use of silicone coatings can be described as modifications of xerographic processes that result in an image-carrying material being implanted on a silicone coating, followed by curing to establish durable adhesion of the particles.

The plates disclosed in the aforementioned U.S. Pat. No. 4,596,733 use a silicone coating as a protective surface layer. This coating is not formulated to release ink, but rather is removable to allow the plates to be used with dampening water applied.

The silicone coating here is preferably a mixture of two or more components, one of which will usually be a linear silicone polymer terminated at both ends with functional (chemically reactive) groups. Alternatively, in place of a linear difunctional silicone, a copolymer incorporating functionality into the polymer chain, or branched structures terminating with functional groups may be used. It is also possible to combine linear difunctional polymers with copolymers and/or branch polymers. The second component will be a multifunctional monomeric or polymeric component reactive with the first component. Additional components and types of functional groups present will be discussed for the coating chemistries that follow.

(a) Condensation Cure Coatings are usually based on silanon (—Si—OH) terminated polydimethylsiloxane polymers (most commonly linear). The silanol group will condense with a number of multifunctional silanes. Some of the reactions are:

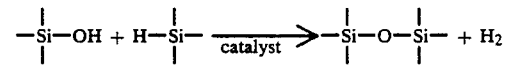

This is a preferred reaction because of the requirement for a catalyst. The silanol terminated polydimethylsiloxane polymer is blended with a polydimethylsiloxane second component to produce a coating that can be stored and which is catalyzed just prior to use. Catalyzed, the coating has a potlife of several hours at ambient temperatures, but cures rapidly at elevated temperatures such as 300° F. Silanes, preferably acyloxy functional, with an appropriate second functional group (carboxy phoshonate, and glycidoxy are examples) can be added to increase coating adhesion. A working example follows.

(b) Addition Cure Coatings are based on the hydrosilation reaction; the addition of Si—H to a double bond catalyzed by a platinum group metal complex. The general reaction is:

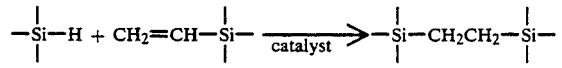

| Functional Group | Reaction | By Product |
|---|---|---|
| Acyloxy | 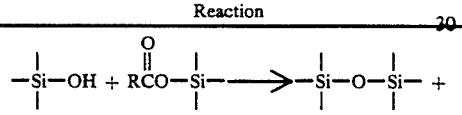 | HOCR |
| Acetoxy | 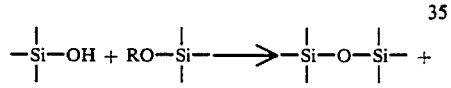 | HOR |
| Oxime | 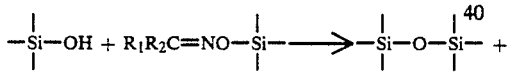 | $HON{=}CR_1R_2$ |

Catalysts such as tin salts or titanates can be used to accelerate the reaction. Use of low molecular weight groups such as $CH_3$— and $CH_3CH_2$— for $R_1$ and $R_2$ also help the reaction rate yielding volatile byproducts easily removed from the coating. The silanes can be difunctional, but trifunctional and tetrafunctional types are preferred.

Condensation cure coatings can also be based on a moisture cure approach. The functional groups of the type indicated above and others are subject to hydrolysis by water to liberate a silanol functional silane which can then condense with the silanol groups of the base polymer. A particularly favored approach is to use acetoxy functional silanes, because the byproduct, acetic acid, contributes to an acidic environment favorable for the condensation reaction. A catalyst can be added to promote the condensation when neutral byproducts are produced by hydrolysis of the silane.

Silanol groups will also react with polymethyl hydrosiloxanes and polymethylhydrosiloxane copolymers when catalyzed with a number of metal salt catalysts such as dibutyltindiacetate. The general reaction is:

Coatings are usually formulated as a two part system composed of a vinyl functional base polymer (or polymer blend) to which a catalyst such as a chloroplantinic acid complex has been added along with a reaction modifier(s) when appropriate (cyclic vinyl-methylsiloxanes are typical modifiers), and a second part that is usually a polymethylhydrosiloxane polymer or copolymer. The two parts are combined just prior to use to yield a coating with a potlife of several hours at ambient temperatures that will cure rapidly at elevated temperatures (300° F., for example). Typical base polymers are linear vinyldimethyl terminated polydimethylsiloxanes and dimethysiloxanevinylmethylsiloxane copolymers. A working example follows.

(c) Radiation Cure Coatings can be divided into two approaches. For U.V. curable coatings, a cationic mechanism is preferred because the cure is not inhibited by oxygen and can be accelerated by post U.V. exposure application of heat. Silicone polymers for this approach utilize cycloaliphatic epoxy functional groups. For electron beam curable coatings, a free radical cure mechanism is used, but requires a high level of inerting to achieve an adequate cure. Silicone polymers for this approach utilize acrylate functional groups, and can be crosslinked effectively by multifunctional acrylate monomers.

Preferred base polymers for the surface coatings 184 discussed are based on the coating approach to be used. When a solvent based coating is formulated, preferred polymers are medium molecular weight, difunctional polydimethylsiloxanes, or difunctional polydimethylsiloxane copolymers with dimethylsiloxane composing 80% or more of the total polymer. Preferred molecular weights range from 70,000 to 150,000. When a 100% solids coating is to be applied, lower molecular weights are desirable, ranging from 10,000 to 30,000. Higher molecular weight polymers can be added to improve coating properties, but will comprise less than 20% of the total coating. When addition cure or condensation cure coatings are to be formulated, preferred second components to react with silanol or vinyl functional groups are polymethylhydrosiloxane or a polymethylhydrosiloxane copolymer with dimethylsiloxane.

Preferably, selected filler pigments 188 are incorporated into the surface layer !84 to support the imaging process as shown in FIG. 4F. The useful pigment materials are diverse, including:

(a) aluminum powders;
(b) molybdenum disulfide powders;
(c) synthetic metal oxides;
(d) silicon carbide powders;
(e) graphite; and
(f) carbon black.

Preferred particle sizes for these materials are small, having average or mean particle sizes considerably less than the thickness of the applied coating (as dried and cured). For example, when an 8 micron thick coating 184 is to be applied, preferred sizes are less than 5 microns and are preferably, 3 microns or less. For thinner coatings, preferred particle sizes are decreased accordingly. Particle 188 geometries are not an important consideration. It is desirable to have all the particles present enclosed by the coating 184 because particle surfaces projecting at the coating surface have the potential to decrease the ink release properties of the coating. Total pigment content should be 20% or less of the dried, cured coating 184 and preferably, less than 10% of the coating. An aluminum powder supplied by Consolidated Astronautics as 3 micron sized particles has been found to be satisfactory. Contributions to the imaging process are believed to be conductive ions that support the spark (arc) from electrode 58 during its brief existence, and considerable energy release from the highly exothermic oxidation that is also believed to occur, the liberated energy contributing to decomposition and volatilization of material in the region of the image formings on the plate.

The ink repellent silicone surface coating 184 may be applied by any of the available coating processes. One consideration not uncommon to coating processes in general, is to produce a highly uniform, smooth, level coating. When this is achieved, the peaks that are part of the structure of the base coat will project well into the silicone layer. The tips of these peaks will be thin points in the silicone layer, which means the insulating effect of the silicone will be lowest at these points contributing to a spark jumping to these points. These projections of the base coat 176 peaks due to particles 177 therein are depicted at P' in FIG. 4F.

Working Examples of Ink Repellent Silicone Coatings

1. Commercial Condensation cure coating supplied by Dow Corning:

| Component | Type | Parts |
|---|---|---|
| Syl-Off 294 | Base Coating | 40 |
| VM&P Naptha | Solvent | 110 |
| Methyl Ethyl Ketone | Solvent | 50 |
| Aliminum Powder | Filler Pigment | 1 |
| | Blend/Disperse Powder/Then Add: | |
| Syl-Off 297 | Acetoxy Functional Silane | 1.6 |
| | Blend/Then Add: | |
| XY-176 Catalyst | Dibutyltindiacetate | 1 |
| | Blend/Then Use: | |

Apply with a #10 Wire Wound Rod
Cure at 300° F. for 1 minute

2. Commercial addition cure coating supplied by Dow Corning:

| Component | Type | Parts |
|---|---|---|
| Syl-Off 7600 | Base Coating | 100 |
| VM-P Naptha | Solvent | 80 |
| Methyl Ethyl Ketone | Solvent | 40 |
| Aliminum Powder | Filler Pigment | 7.5 |
| | Blend/Disperse Powder/Then Add: | |
| Syl-Off 7601 | Crosslinker | 4.8 |
| | Blend/Then Use: | |

Apply with a #4 Wire Wound Rod
Cure at 300° F. for 1 minute
This coating can also be applied as a 100% solids coating (same formula without solvents) via offset gravure and cured using the same conditions.

3. Lab coating formulations illustrating condensation cure and addition cure coatings are given in the following Table 1. Indentity of indicated components are given in the following Table 2. All can be applied by coating with wire wound rods and cured in a convection oven set at 300° F. using a 1 minute dwell time. Coating 4 can be applied as a 100% solids coating and cured under the same conditions.

TABLE 1

| Formulation: | Condensation Cure Coatings | | | Addition Cure Coatings | | | | |
|---|---|---|---|---|---|---|---|---|
| Parts Basis | 1 | 2 | 3 | 4 | 5 | 6 | 7 | 8 |
| Components | | | | | | | | |
| PS - 345.5 | 20 | 20 | — | — | — | — | — | — |
| PS - 347.5 | — | — | 20 | — | — | — | — | — |
| PS - 424 | — | — | — | — | 50 | — | — | — |
| PS - 442 | — | — | — | 64 | — | — | — | — |
| PS - 445 | — | — | — | — | — | 50 | — | — |
| PS - 447.6 | — | — | — | — | — | — | 50 | 50 |
| PS - 120 | 2 | — | 2 | 2 | 4 | 1 | 1 | — |
| PS - 123 | — | 6 | — | — | — | — | — | 2 |
| T - 2160 | — | — | — | 1 | 1 | — | — | — |
| Sly-OFF 297 | 2 | 2 | 2 | — | — | — | — | — |
| Dibutyltindi-acetate | 1.2 | 1.2 | 1.2 | — | — | — | — | — |
| PC - 085 | — | — | — | 0.05 | 0.05 | 0.05 | 0.1 | 0.1 |
| VM & P Naptha | 118 | 114 | 148 | 64 | 55 | 100 | 133 | 133 |
| Methyl Ethyl Ketone | 60 | 60 | 75 | — | 55 | 50 | 67 | 67 |
| Aluminum Powder | 2 | 2 | 2 | 4 | 3 | 3 | 3 | 3 |

TABLE 2

| Component | Type | Molecular Weight | Supplier |
|---|---|---|---|
| PS - 345.5 | Silanol Terminated Polydimethylsiloxane | 77000 | Petrarch Systems |
| PS - 347.5 | Silanol Terminated Polydimethylsiloxane | 110000 | Petrarch Systems |
| PS - 424 | Dimethylsiloxane - Vinymethylsiloxane Copolymer 7.5% Vinylmethyl | | Petrarch Systems |

TABLE 2-continued

| Component | Type | Molecular Weight | Supplier |
|---|---|---|---|
| | Comonomer | | |
| PS - 442 | Vimyldimethyl Terminated Polydimethylsiloxane | 17000 | Petrarch Systems |
| PS - 445 | Vimyldimethyl Terminated Polydimethylsiloxane | 63000 | Petrarch Systems |
| PS - 447.6 | Vimyldimethyl Terminated Polydimethylsiloxane | 118000 | Petrarch Systems |
| PS - 120 | Polymethylhydrosiloxane | 2270 | Petrarch Systems |
| PS - 123 | (30–35%) Mehylhydro - (65–70%) Dimethylsiloxane Copolymer | 2000–2100 | Petrarch Systems |
| T - 2160 | 1,3,5,7 Tetravinyltetra-methylcyclotetrasiloxane | Systems | Petrarch |
| Syl-Off 297 | Acetoxy Functional Silane | Dow | Corning |
| PC - 085 | Platinum - Cyclvinylmethylsiloxane Complex | | Petrarch Systems |

When plate 172 is subjected to a writing operation as described above, electrode 58 is pulsed, preferably negatively, at each image point I on the surface of the plate. Each such pulse creates a spark discharge between the electrode tip **58*b* and the plate, and more particularly across the small gap d between tip 58*b* and the metallic underlayer 178 at the location of a particle 177 in the base coat 176. Where the repellent outer coat 184 is thinnest. This localizing of the discharge allows close control over the shape of each dot and also over dot placement to maximize image accuracy. The spark discharge etches or erodes away the ink repellent outer layer 184 (including its primer layer 186, if present) and the metallic underlayer 178 at the point I directly opposite the electrode tip 58*b* thereby creating a well I' at that image point which exposes the underlying oleophyllici surface of base coat or layer 176. The pulses to electrode 58 should be very short, e.g. 0.5 microseconds to avoid arc "fingering" along layer 178 and consequent melting of that layer around point I. The total thickness of layers 178, 182 and 184, i.e. the depth of well I', should not be so large relative to the width of the image point I that the well I' will not accept conventional offset inks and allow those inks to offset to the blanket cylinder 14** when printing.

Plate 172 is used in press 10 with the press being operated in its dry printing mode. The ink from ink roller **22*a* will adhere to the plate only at the image points I thereby creating an inked image on the plate that is transferred via blanket roller 14 to the paper sheet P carried on cylinder 16**.

Instead of providing a separate metallic underlayer 178 in the plate as in FIG. 4F, it is also feasible to use a conductive plastic film for the conductive layer A suitable conductive material for layer 184 should have a volume resistivity of 100 ohm centimeters or less, Dupont's 200×C600 Kapton brand film being one example. This is an experimental film in which the normally nonconductive material has been filled with conductive pigment to create a conductive film.

To facilitate spark discharge to the plate, the base coat 176 may also be made conductive by inclusion of a conductive pigment such as one of the preferred base coat pigments identified above.

Also, instead of producing peaks P' by particles 177 in the base coat, the substrate 174 may be a film with a textured surface that forms those peaks. Polycarbonate films with such surfaces are available from General Electric Co. Another possibility is to coat the oleophobic surface layer directly onto a metal or conductive plastic substrate having a textured surface so that the substrate forms the conductive peaks. For example, a silicone-coated textured chrome plate has been successfully imaged in accordance with our process. It is also feasable to provide a textured surface on the surface layer so that the spark discharges are localized at the peaks defined by that texturing.

All of the lithographic plates described above can be imaged on press 10 or imaged off press by means of the spark discharge imaging apparatus described above. The described plate constructions in toto provide both direct and indirect writing capabilities and they should suit the needs of printers who wish to make copies on both wet and dry offset presses with a variety of conventional inks. In all cases, no subsequent chemical processing is required to develop or fix the images on the plates. The coaction and cooperation of the plates and the imaging apparatus described above thus provide, for the first time, the potential for a fully automated printing facility which can print copies in black and white or in color in long or short runs in a minimum amount of time and with a minimum amount of effort.

It will thus be seen that the objects set forth above, among those made apparent from the preceding description, are efficiently attained and, since certain changes may be made in carrying out the above process, in the described products, and in the constructions set forth without departing from the scope of the invention, it is intended that all matter contained in the above description or shown in the accompanying drawings shall be interpreted as illustrative and not a limiting sense.

It is also to be understood that the following claims are intended to cover all of the generic and specific features of the invention herein described.

We claim:

1. A method for making a printing member for a press with dampening comprising the steps of:

forming a metal body with an exposed oxidized surface having a grained surface structure which renders said surface hydrophilic, and heating said body surface at selected image points thereon without contacting said surface and without penetrating through said body so that there is a transformation of said surface structure which renders said surface oleophilic at said image points.

2. The method defined in claim 1 and including the step of continuing said heating until molten metal flows from the interior of said body through said surface structure at said image points.

3. The method defined in claim 2 including the step of forming said body of aluminum.

4. The method defined in claim 2 including the step of forming said body as a flexible layer which can extend around a print cylinder.

5. The method define in claim 7 including the step of forming said body as a rigid cylinder having an oxidized cylindrical surface.

6. The method defined in claim 1 including the step of heating said surface by spacing said surface opposite a point electrode and establishing a potential difference between said electrode and said body at said image points so as to produce spark discharges between said electrode and said surface at said image points.

7. The method defined in claim 6 including the step of producing said spark discharges by applying momentary voltage pulses image-wise between said electrode and said body so that a multiplicity of image-representing oleophilic spots are formed on the otherwise hydrophilic body surface.

8. The method defined in claim 7 and including the step of pulsing said electrode negative relative to said body.

9. The method defined in claim 1 including the step of coating said surface with waterless ink after the body surface is heated at said selected image points;

applying dampening liquid to the coated surface to dislodge the ink from said surface except at said image points thereon thereby leaving ink spots at said image points; and setting said ink spots.

10. The method defined in claim 9 including the steps of selecting a radiation curable ink; and applying radiation to said ink spots to set same.

11. A printing member for a press with dampening comprising a metal body having an exposed oxidized surface with a grained surface structure which renders said surface hydrophilic, said body surface being heated at selected image points thereon without contacting said surface and without penetrating through said body whereby there is a transformation of said grained surface structure which renders said surface oleophilic at said image points.

12. The printing member defined in claim 11 wherein said body is of aluminum.

13. The printing member defined in claim 11 wherein said body is a flexible layer which can extend around a print cylinder.

14. The printing member defined in claim 11 wherein said body is a rigid cylinder and said oxidized surface is a cylindrical surface of said cylinder.

15. The printing member defined in claim 11 and further including a coating of waterless ink covering said transformed surface structure.

16. The printing member defined in claim 15 wherein said ink is a radiation curable link.

* * * * *